United States Patent [19]

Podrini et al.

[11] Patent Number: 4,671,433

[45] Date of Patent: Jun. 9, 1987

[54] CONTINUOUS CASTING NOZZLE

[75] Inventors: Maurizio Podrini; Alessandro Ferretti, both of Rome; Giancarlo Di Schino, Terni, all of Italy

[73] Assignees: Centro Sperimentale Metallurgico SpA; Terni-Societa per l'Industria e l'Elettricita SpA, both of Rome, Italy

[21] Appl. No.: 912,679

[22] Filed: Sep. 26, 1986

Related U.S. Application Data

[63] Continuation of Ser. No. 753,332, Jul. 9, 1985, abandoned.

[30] Foreign Application Priority Data

Jul. 24, 1984 [IT] Italy ..... 48616 A/84

[51] Int. Cl.[4] ..... B22D 11/10

[52] U.S. Cl. ..... 222/606; 164/437

[58] Field of Search ..... 164/437, 488, 489; 222/590, 591, 594, 606

[56] References Cited

U.S. PATENT DOCUMENTS

| | | | |
|---|---|---|---|
| 3,669,181 | 6/1972 | Schrewe | 164/437 |
| 3,867,978 | 2/1975 | Johansson et al. | 164/437 X |
| 3,954,134 | 5/1976 | Maas et al. | 164/437 X |

FOREIGN PATENT DOCUMENTS

| | | | |
|---|---|---|---|
| 51-44516 | 4/1976 | Japan | 164/437 |
| 55-141365 | 11/1980 | Japan | 164/437 |
| 499038 | 6/1976 | U.S.S.R. | 164/437 |

*Primary Examiner*—Nicholas P. Godici
*Assistant Examiner*—J. Reed Batten, Jr.
*Attorney, Agent, or Firm*—Young & Thompson

[57] ABSTRACT

A submerged continuous casting nozzle consists of a tubular element having an axial passage terminating in an end part having terminal conduits extending laterally and downwardly from the vertical axis of the nozzle. The lower end of each of these terminal discharge conduits has a lip protruding toward the axis of the associated conduit, this lip having a height between 0.3 and 0.6 times the diameter of the outflow port. The lip makes an angle of about 90° with the axis of the associated terminal conduit.

1 Claim, 3 Drawing Figures

CONTINUOUS CASTING NOZZLE

This application is a continuation of application Ser. No. 753,332, filed July 9, 1985 and now abandoned.

DESCRIPTION

The present invention relates to an improvement in continuous casting nozzles and, more precisely, concerns the nozzles which deliver the liquid steel into the mould.

Continuous casting is a well-known process firmly established in most steelworks, and while a high level of perfection has been attained, some aspects still require attention; though these may be of relatively minor importance, they can however cause annoying problems.

For instance, it is known that at the start of casting, when the starter slab is inserted in the mould which is still empty, the steel must be cast rapidly, and the stream must leave the nozzle with a downwards trajectory so as to avoid material being thrown towards the outside. Once the mould is full, however, and the starter slab has been extracted, the situation is completely reversed. Indeed, during the course of the casting, the steel can be cast at a lower rate than at the start and it is also preferable that the stream should no longer be directed downwards into the mould, but should be directed so as to ensure energetic circulation of the liquid steel in the mould, to attain more uniform temperature, to decrease the amount of segregation and to favour the rise of nonmetallic impurities to the surface.

No single satisfactory solution has been found for these contrasting requirements and since it is clearly impossible to change nozzles during casting a compromise has been adopted; namely the use of nozzles with side outlets angled somewhat from the vertical. This solution is only partly satisfactory, however, since in some cases it can create problems during the initial mould-filling phase and also during the course of the casting process.

The present invention is designed to overcome these difficulties by providing a nozzle which is capable of delivering a stream of liquid steel in radically different directions during the two stages of the casting operation.

According to this invention, a submerged continuous casting nozzle, whose terminal delivery conduits slope laterally and downwards from the vertical axis of the nozzle, in the manner already known, is modified by introducing a lip on the outlet end which is directed decidedly towards the axis of the terminal conduit. The height of the lip and the angle it makes with the axis of the terminal conduit of the nozzle depend on the type of continuous casting plant involved and especially on the casting speed.

However, very broadly speaking, it can be said that the height of the lip can be between 0.3 and 0.6 times the diameter of the outflow port, while the angle it makes with the axis of the terminal conduits of the nozzle is around 90 degrees.

The present invention will now be described in greater detail in relation to an embodiment provided purely by way of example and in no way intended as being restrictive. This embodiment is illustrated in the accompanying drawing where:

Figure 1:
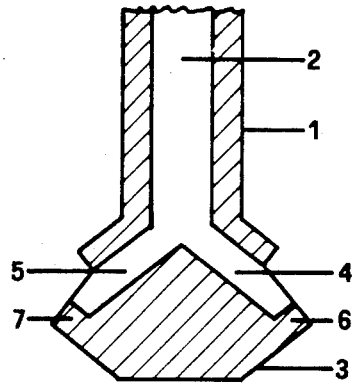
FIG. 1 represents a vertical section through the device as per the invention.

With reference to FIG. 1, the nozzle consists of a tubular element 1 with an axial passage 2, terminating at one extremity with a connection (not shown) to the tundish or ladle and the other with an end part 3 complete with discharge conduits 4 and 5, set at an angle to the axis of element 1. These discharge conduits are, of course, in communication with axial passage 2.

The lower end part of conduits 4 and 5 has a lip, indicated as 6 and 7 respectively, projecting at right angles toward the axis of conduits 4 and 5.

The operation of the nozzle, as per the objects of the present invention, depends on these lips.

Figure 2:
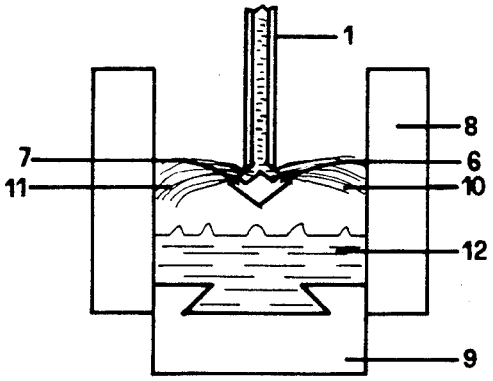
FIG. 2 represents a schematic view, partly in section, not to scale, of the FIG. 1 device during the mould-filling operation.

As illustrated in FIG. 2, at the start of operations, when mould 8 still has to be filled and a starter slab 9 is still in position in the mould, casting is performed at a considerable speed; in this situation the lips 6 and 7 have no great influence on the form of the steel streams 10 and 11 delivered from the relevant discharge conduits. The streams are thus directed downwards and go to form the liquid bath 12 in the mould. When this is full and a sufficiently thick skin of solid steel has been formed, the starter slab is extracted and continuous casting proper then begins, with the steady, continuous extraction of the slab solidified only on the skin.

Figure 3:
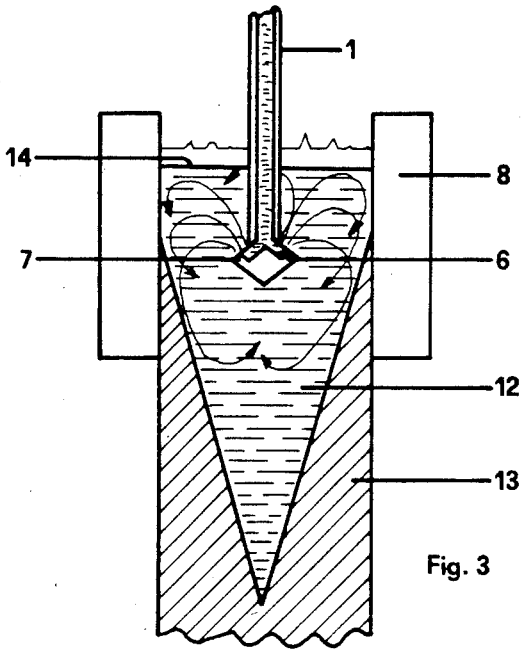
FIG. 3 is a similar view to that of FIG. 2 but during the casting operation proper.

This situation is schematized in FIG. 3 where the slab 13 is sectioned at the point where it is solid across its entire section. As already indicated, during the casting operation, the steel passes through the nozzle at a lower rate than when the mould is being filled; this—together with the fact that the delivery nozzle is now submerged and hence the steel flows in an ambient of the same density and visocity—results in the flow of the stream being disturbed by the lips 6 and 7, which deflect it upwards. The arrows in FIG. 3 provide a rough indication of the direction of flow of steel delivered by the nozzle as per this invention, as confirmed by full-scale tests on a transparent model in which the fluid consisted of water and tracers.

This radical alteration in the flow of molten steel in the liquid bath 12 induces effects that are very marked and most beneficial from the point of view of the exchange of steel at the upper surface and within the bath itself. As proved by practical tests in the steelworks, the deflected stream laps the steel-slag interface (14) though without excessive turbulence and also causes significant stirring of the bath in the area around the nozzle itself. This ensures excellent homogenization of the bath temperature and composition, thus improving the solidification pattern, while decreasing segregation. Moreover, the good circulation of molten steel at the steel-slag interface facilitates the removal of inclusions from the bath and results in a higher local temperature at the bath-slag interface than in the case of other nozzles. This higher temperature renders the steel more fluid and makes enclosures of impurities in the skin formed at the upper part of the mould more difficult, so there is an improvement in the surface quality of the slab.

We claim:

1. In a submerged continuous casting nozzle consisting of a tubular element having an axial passage and terminating in an end part having terminal conduits having geometrical axes extending laterally and downwards from the vertical axis of said nozzle, said terminal conduits defining outflow ports for molten metal; the improvement in which each of these terminal discharge conduits is bounded by upper and lower parallel walls of a length substantially greater than the distance between said walls, said lower wall extends laterally outwardly a substantial distance beyond said upper wall and terminates in a lip protruding decidedly towards the axis of said terminal conduits, said lip is spaced from said upper wall a distance substantially greater than said distance between said walls, and the height of said lip is between 0.3 and 0.6 times the diameter of the outflow port, said lip being disposed at an angle of about 90° with said walls.

* * * * *